US006615015B2

(12) United States Patent
Nakazawa et al.

(10) Patent No.: US 6,615,015 B2
(45) Date of Patent: Sep. 2, 2003

(54) PROCESS CARTRIDGE, ELECTROPHOTOGRAPHIC APPARATUS AND IMAGE-FORMING METHOD

(75) Inventors: Akihiko Nakazawa, Shizuoka (JP); Hiroyuki Kobayashi, Shizuoka (JP); Atsushi Tanaka, Shizuoka (JP); Tsunenori Ashibe, Kanagawa (JP); Takashi Kusaba, Shizuoka (JP); Hidekazu Matsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/151,104

(22) Filed: May 21, 2002

(65) Prior Publication Data

US 2003/0072585 A1 Apr. 17, 2003

(30) Foreign Application Priority Data

May 24, 2001 (JP) ..... 2001-155881

(51) Int. Cl.[7] ..... G03G 15/00; G03G 15/16; G03G 21/18

(52) U.S. Cl. ..... 399/302; 399/101; 399/113; 399/308; 428/141

(58) Field of Search ..... 399/302, 308, 399/113, 111, 101; 428/141

(56) References Cited

U.S. PATENT DOCUMENTS

| | | | | |
|---|---|---|---|---|
| 4,873,548 | A | 10/1989 | Kobayashi et al. | 399/111 |
| 5,116,711 | A | 5/1992 | Kobayashi et al. | 430/109.4 |
| 5,149,610 | A | 9/1992 | Kobayashi et al. | 430/109.4 |
| 5,164,275 | A | 11/1992 | Kobayashi et al. | 430/45 |
| 5,440,373 | A | 8/1995 | Deki et al. | 399/113 |
| 5,446,525 | A | 8/1995 | Kobayashi | 399/111 |
| 5,452,056 | A | 9/1995 | Nomura et al. | 399/111 |
| 5,585,889 | A | 12/1996 | Shishido et al. | 399/113 |
| 5,585,902 | A | 12/1996 | Nishiuwatoko et al. | 399/106 |
| 5,587,769 | A | 12/1996 | Sawada et al. | 399/113 |
| 5,752,131 | A | 5/1998 | Fujiwara et al. | 399/106 |
| 5,761,594 | A * | 6/1998 | Seto et al. | 399/302 |
| 5,802,427 | A | 9/1998 | Sawada et al. | 399/122 |
| 5,870,654 | A | 2/1999 | Sato et al. | 399/109 |
| 5,966,566 | A | 10/1999 | Odagawa et al. | 399/109 |
| 5,991,570 | A * | 11/1999 | Haga et al. | 399/113 X |
| 5,999,784 | A * | 12/1999 | Tsukida et al. | 399/302 X |
| 6,336,025 | B1 * | 1/2002 | Saeki | 399/302 X |
| 2001/0031153 | A1 * | 10/2001 | Sameshima et al. | 399/111 |
| 2002/0106497 | A1 * | 8/2002 | Ishiguro et al. | 428/212 |

FOREIGN PATENT DOCUMENTS

| | | |
|---|---|---|
| JP | 63-301960 | 12/1988 |
| JP | 6-110261 | 4/1994 |
| JP | 8-137181 | 5/1996 |
| JP | 10-177329 | 6/1998 |
| JP | 11-30944 | 2/1999 |
| JP | 11-167290 | * 6/1999 |
| JP | 2001-282011 | * 10/2001 |

* cited by examiner

*Primary Examiner*—Sophia S. Chen
(74) *Attorney, Agent, or Firm*—Fitzpatrick, Cella, Harper & Scinto

(57) ABSTRACT

A process cartridge is disclosed integrally supporting an electrophotographic photosensitive member, an intermediate transfer belt, a primary-transfer member for transferring a toner image primarily from the electrophotographic photosensitive member to the intermediate transfer belt and a charge-providing member for providing the toner on the intermediate transfer belt with electric charges having a polarity reverse to the polarity the toner has at the time of the primary transfer and returning the toner on the intermediate transfer belt to the electrophotographic photosensitive member at the contact zone to clean the intermediate transfer belt. The intermediate transfer belt has a modulus of elasticity of from 500 MPa to 4,000 MPa at elongation from 0.5% to 0.6% in the peripheral direction, a breaking extension of from 5% to 850% in the peripheral direction and a surface roughness Ra of 1 $\mu$m or less.

24 Claims, 7 Drawing Sheets

PROCESS CARTRIDGE, ELECTROPHOTOGRAPHIC APPARATUS AND IMAGE-FORMING METHOD

BACKGROUND OF THE INVENTION

1. Field of the Invention

This invention relates to a process cartridge, an electrophotographic apparatus and an image-forming method.

2. Related Background Art

Image-forming apparatus making use of an intermediate transfer belt are effective as full-color or multi-color image-forming electrophotographic apparatus in which a plurality of component-color toner images corresponding to full-color image information or multi-color image information are sequentially transferred to and superimposed on a transfer medium to output an image-formed material on which a full-color image or multi-color image has synthetically been reproduced.

Compared with conventional-technique full-color electrophotographic apparatus having an image-forming system in which toner images are transferred from a first image-bearing member electrophotographic photosensitive member to a second image-bearing member transfer medium fastened or attracted onto a transfer drum (e.g., the transfer system disclosed in Japanese Patent Application Laid-Open No. 63-301960), the full-color electrophotographic apparatus having an intermediate transfer belt have such an advantage that a great variety of second image-bearing members (transfer media) can be selected without regard to their width and length, including thin paper (40 g/m$^2$ paper) and even thick paper (200 g/m$^2$ paper) such as envelopes, post cards and labels. This is because the use of the intermediate transfer belt makes any processing or control (e.g., the transfer medium is held with a gripper, attracted, and made to have a curvature) unnecessary for the transfer medium.

In addition, the intermediate transfer member made in the shape of a belt enables effective utilization of space to make the apparatus main body compact and achieve cost reduction, because placement freedom in the image-forming apparatus can be greater than a case in which a rigid cylinder such as an intermediate transfer drum is used.

However, the intermediate transfer belt has a shorter lifetime than the electrophotographic-apparatus main body, and hence, under the existing conditions, it is indispensable to replace the belt in the middle of the use of apparatus. At the same time, it is necessary to install a waste-toner container in which the toner having remained on the intermediate transfer belt is to be collected, and to dispose of the toner thus collected.

In addition to these, it is necessary to replace many component parts such as an electrophotographic photosensitive member and a developing assembly, and the toner.

As a method of making these replacement parts into a unit or units (process cartridge) so as to be attached to or detached from the main body with ease, Japanese Patent Application Laid-Open No. 8-137181 discloses a technique in which the intermediate transfer belt and the electrophotographic photosensitive member are made into units independent of each other and are so placed as to be attached to or detached from the main body with ease.

However, such a means requires replacement units in a large number and makes user's operation troublesome. Also, since the units are designed and placed independently of each other, a problem may arise such that the apparatus must be made large-sized and may involve a high cost.

As a means for solving such a problem, a technique is proposed in which the intermediate transfer belt and the electrophotographic photosensitive member as replacement parts are made into one unit (process cartridge) so as to be simultaneously attached to or detached from the main body and replaced. Such a technique is disclosed in, e.g., Japanese Patent Applications Laid-Open No. 6-110261, No. 10-177329 and No. 11-30944.

However, differently from a case in which the intermediate transfer belt is set at the time the apparatus main body is installed, such a technique in which the intermediate transfer belt and the electrophotographic photosensitive member are set up as one unit to provide a process cartridge which can be attached to or detached from the main body with ease, namely, the intermediate transfer belt and the electrophotographic photosensitive member are integrally set as a process cartridge, tends to cause some problems ascribable to the intermediate transfer belt.

One of such problems is a lowering of belt strength which is caused by a tension applied to the intermediate transfer belt.

Usually, in order for the intermediate transfer belt to be surely driven without slipping, a tension must be applied thereto, where the process cartridge in which the intermediate transfer belt and the electrophotographic photosensitive member are integrally supported stands stationary as the tension is kept applied for a long time until it is actually put into use. As a result, the intermediate transfer belt may cause a creep to increase in peripheral length.

The peripheral length having increased is absorbed to a certain extent by a tension roller having a stroke. However, the belt has already come to have a lower modulus of elasticity than an initial preset value, and may cause serious color misregistration when used actually, resulting in a lowering of the image quality level.

An intermediate transfer belt having a small elongation may also have such a great problem that it is cracked because of such tension and vibration at the time of distribution in the market.

The phenomenon of creep is known to accelerate in a high-temperature environment, and the process cartridge in which the intermediate transfer belt and the electrophotographic photosensitive member are integrally supported must be designed also taking account of such a high-temperature environment the process cartridge may encounter during its distribution.

In particular, with the progress in techniques for manufacturing image-forming apparatus in recent years, it has become possible for digital-development type printers and copying machines to develop minute and accurate latent images with a resolution of 600 dpi or more as exposure spots have been made smaller in size and more highly dense, and to obtain images with a high quality on account of, e.g., precise control of electric fields. As a result, a change in the modulus of elasticity and the surface roughness of the intermediate transfer belt, which have not come into question in the past, may greatly affect image quality, and it is an important subject to solve this problem.

In the above conventional techniques, however, measures have been taken to address difficulties the process cartridge, in which the intermediate transfer belt and the electrophotographic photosensitive member are integrally supported, may have when, e.g., it is left for a long time during transportation and storage, and it can not be said that any process cartridges have been designed taking such distribution channels into account. Hence, in the conventional process cartridge in which the intermediate transfer belt and the electrophotographic photosensitive member are integrally supported, there are problems such that a high management cost may result because of, e.g., strict safekeeping and restriction on a period of service, and that complaints from users may increase.

In addition, it is also an important subject to reduce running cost, and much more cost reduction must be achieved on the process cartridge in which the intermediate transfer belt and the electrophotographic photosensitive member are integrally supported and which come to be a replacement part. Also, in order to make handling easy, the miniaturization and the disposal of waste toner should fully be taken into consideration.

Thus, any process cartridge having perfectly solved the technical problems peculiar to the process cartridge in which the intermediate transfer belt and the electrophotographic photosensitive member are integrally supported and any electrophotographic photosensitive member having such a process cartridge have not been made available.

SUMMARY OF THE INVENTION

An object of the present invention is to provide a process cartridge which is easy to maintain, enables miniaturization and cost reduction of the apparatus, and affords good images even when having been transported or left over a long period of time; an electrophotographic apparatus having such a process cartridge; an image-forming method making use of such an electrophotographic apparatus; and an intermediate transfer belt for such a process cartridge.

The present inventors have made extensive studies on the achievement of simple maintenance, miniaturization and cost reduction of process cartridges and improvement in image quality. As a result, they have discovered that the intended object can be achieved by employing a process cartridge in which the intermediate transfer belt and the electrophotographic photosensitive member are integrally supported, further in combination with some measures.

More specifically, the present invention is a process cartridge which is detachably mountable to the main body of an electrophotographic apparatus; the process cartridge integrally comprising:

an electrophotographic photosensitive member for holding thereon a toner image;

an intermediate transfer belt having a contact zone coming into contact with the electrophotographic photosensitive member;

a primary-transfer means for primarily transferring the toner image from the electrophotographic photosensitive member to the intermediate transfer belt at the contact zone; and a charge-providing means for providing the toner on the intermediate transfer belt with electric charges having a polarity reverse to a polarity the toner has at the time of the primary transfer and returning the toner on the intermediate transfer belt to the electrophotographic photosensitive member at the contact zone to clean the intermediate transfer belt, the intermediate transfer belt having:

a modulus of elasticity of from 500 MPa to 4,000 MPa at elongation from 0.5% to 0.6% in the peripheral direction;

a breaking extension of from 5% to 850% in the peripheral direction; and a surface roughness Ra of 1 $\mu$m or less.

The present invention is also an electrophotographic apparatus comprising:

an electrophotographic photosensitive member for holding thereon a toner image;

a charging means for charging the electrophotographic photosensitive member electrostatically;

an exposure means for forming an electrostatic latent image on the electrophotographic photosensitive member thus charged by the charging means;

a developing means for developing the electrostatic latent image formed on the electrophotographic photosensitive member by the exposure means, to form a toner image on the electrophotographic photosensitive member;

an intermediate transfer belt having a contact zone coming into contact with the electrophotographic photosensitive member, through which the toner image is primarily transferred from the electrophotographic photosensitive member and thereafter the toner image having primarily been transferred is secondarily transferred to a transfer medium;

a primary-transfer means for primarily transferring the toner image from the electrophotographic photosensitive member to the intermediate transfer belt at the contact zone;

a charge-providing means for providing the toner on the intermediate transfer belt with electric charges having a polarity reverse to a polarity the toner has at the time of the primary transfer, in order to return the toner on the intermediate transfer belt to the electrophotographic photosensitive member at the contact zone to clean the intermediate transfer belt; and an electrophotographic-photosensitive-member cleaning means for cleaning the electrophotographic photosensitive member;

the electrophotographic apparatus having a process cartridge in which the electrophotographic photosensitive member, the intermediate transfer belt, the primary-transfer means and the charge-providing means at least are integrally supported and detachably mountable on the main body of the electrophotographic apparatus; and the intermediate transfer belt having:

a modulus of elasticity of from 500 MPa to 4,000 MPa at elongation from 0.5% to 0.6% in the peripheral direction;

a breaking extension of from 5% to 850% in the peripheral direction; and a surface roughness Ra of 1 $\mu$m or less.

The present invention is still also an image-forming method comprising the steps of:

a charging step of electrostatically charging an electrophotographic photosensitive member;

an exposure step of forming an electrostatic latent image on the electrophotographic photosensitive member thus charged in the charging step;

a developing step of developing the electrostatic latent image formed on the electrophotographic photosensitive member in the exposure step, to form a toner image on the electrophotographic photosensitive member;

a primary-transfer step of primarily transferring the toner image formed in the developing step from the electrophotographic photosensitive member to an intermediate transfer belt by a primary-transfer means, the intermediate transfer belt having a contact zone coming into contact with the electrophotographic photosensitive member;

a secondary-transfer means for secondarily transferring to a transfer medium the toner image having primarily been transferred in the primary-transfer step;

a charge-providing step of providing the toner on the intermediate transfer belt with electric charges by a charge-providing means, the electric charges having a polarity reverse to the polarity the toner has at the time of the primary transfer;

an intermediate-transfer-belt cleaning step of returning the toner on the intermediate transfer belt to the electrophotographic photosensitive member at the contact zone to clean the intermediate transfer belt; and an electrophotographic-photosensitive-member cleaning step of cleaning the electrophotographic photosensitive member;

the image-forming method making use of an electrophotographic apparatus having a process cartridge in which the electrophotographic photosensitive member, the intermediate transfer belt, the primary-transfer means and the charge-providing means at least are integrally supported and detachably mountable to the main body of the electrophotographic apparatus; and the intermediate transfer belt having:

a modulus of elasticity of from 500 MPa to 4,000 MPa at elongation from 0.5% to 0.6% in the peripheral direction;

a breaking extension of from 5% to 850% in the peripheral direction; and a surface roughness Ra of 1 $\mu$m or less.

DETAILED DESCRIPTION OF THE INVENTION

Figure 1:
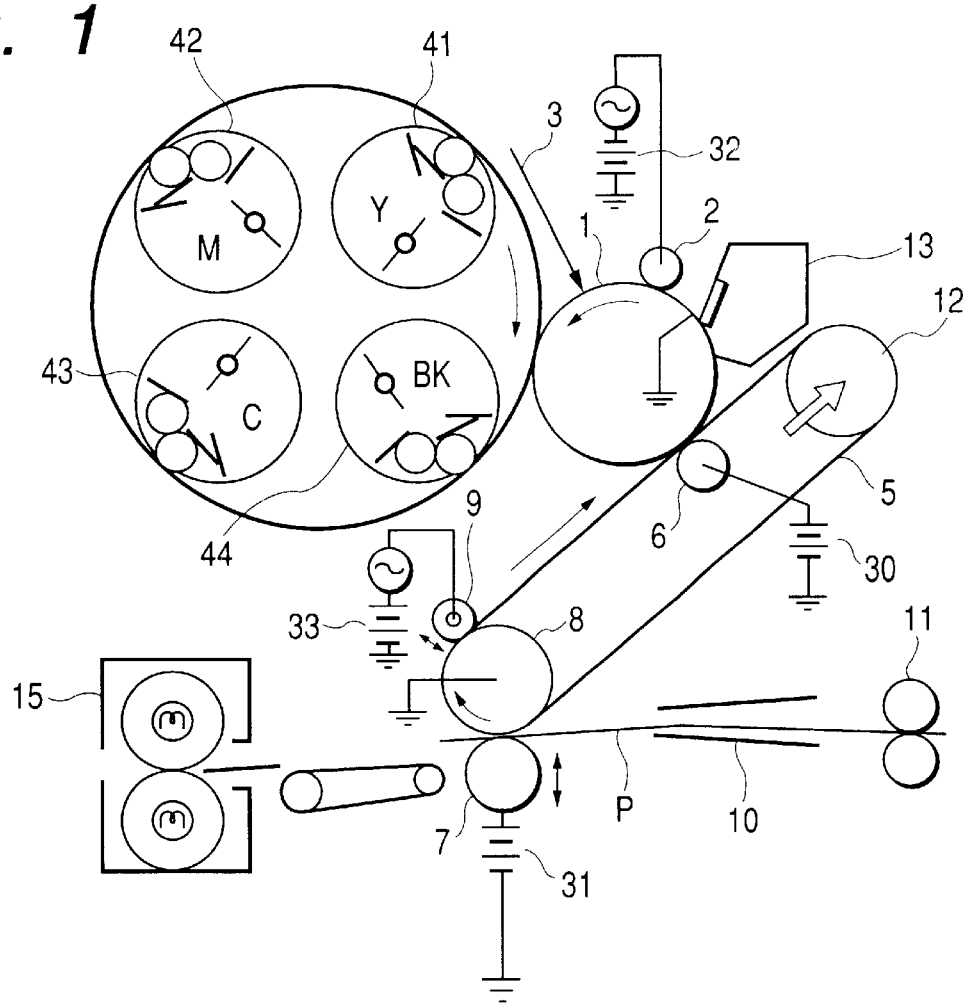
FIG. 1 is a schematic sectional view showing an example of an electrophotographic apparatus making use of the intermediate transfer belt/electrophotographic photosensitive member integral cartridge of the present invention.

Embodiments of the present invention are described below in detail.

The process cartridge of the present invention is a process cartridge in which an intermediate transfer belt and an electrophotographic photosensitive member are integrally supported (herein also "intermediate transfer belt/electrophotographic photosensitive member integral cartridge").

In the present invention, for the purpose of miniaturization and cost reduction of process cartridges, a cleaning mechanism for the intermediate transfer belt employs the so-called cleaning-at-primary-transfer method (also called "bias cleaning method"), in which the transfer residual toner is charged to a reverse polarity and is returned from the intermediate transfer belt to the electrophotographic photosensitive member simultaneously with primary transfer.

Stated specifically, it is a method in which electric charges with a polarity reverse to that at the time of primary transfer are imparted to the toner having remained on the intermediate transfer belt at the time of secondary transfer, by applying a voltage to a charge-providing member disposed separably on the intermediate transfer belt, and the toner is returned to the electrophotographic photosensitive member by the aid of a primary-transfer electric field at the subsequent primary-transfer zone.

The toner having been returned from the surface of the intermediate transfer belt to the electrophotographic photosensitive member is removed by a cleaning means for the electrophotographic photosensitive member, such as a cleaning blade.

This method is greatly effective to make the cartridge compact and low-cost, compared with a method in which cleaning blades or the like are provided for both the electrophotographic photosensitive member and the intermediate transfer belt and a feed mechanism for waste toner and a container therefor are installed.

In addition, in the present invention, the process cartridge is designed for strength, considering that a tension is applied to the intermediate transfer belt for a long time and also the environment may change to cause the phenomenon of creep. Hence, even an intermediate transfer belt cartridge which has been manufactured for a long time can form good images without causing any problems.

Stated specifically, the intermediate transfer belt has a modulus of elasticity of 500 MPa to 4,000 MPa at elongation from 0.5% to 0.6% in the peripheral direction. As long as it has a modulus of elasticity of 500 MPa or more, color misregistration may be reduced when images are formed. On the other hand, if it has a modulus of elasticity of more than 4,000 MPa, the intermediate transfer belt may have so high a rigidity as to hinder its smooth rotation.

The intermediate transfer belt also has a breaking extension of from 5% to 850% in the peripheral direction. If it has a breaking extension of less than 5%, it may be brittle as a belt to cause a break upon a little elongation. Hence, in the case of the process cartridge expected to be stored for a long term as a tension is kept applied until it is put to use, there may occur such a problem that the intermediate transfer belt has a short lifetime. On the other hand, if it has a breaking extension of more than 850%, the intermediate transfer belt may elongate so greatly that it may undergo expansion and contraction at the time of its rotation to cause color misregistration.

As to the intermediate transfer belt, its surface roughness must also be taken into account. It may have a surface roughness Ra of 1 $\mu$m or less. If it has a surface roughness Ra of more than 1 $\mu$m, the transfer performance may be affected to cause coarse halftone images or a lowering of fine-line reproducibility. Also, the electric charges imparted to the secondary-transfer residual toner may become non-uniform, or intermediate transfer belt faulty cleaning may occur in which the secondary-transfer residual toners are not sufficiently returned to the electrophotographic photosensitive member to cause such a trouble that previously printed images remain on subsequently printed images at the time of continuous printing.

In particular, these problems concerning images may remarkably occur in electrophotographic apparatus having a digital exposure means which forms electrostatic latent images on the surface of the electrophotographic photosensitive member by a digital method with a resolution of 600 dpi or more.

Meanwhile, in order to make the intermediate transfer belt/electrophotographic photosensitive member integral cartridge have a smaller size and lower price, it is also important to select the shape of the electrophotographic photosensitive member to be incorporated in the cartridge. Accordingly, the electrophotographic photosensitive member may preferably be a small-diameter, drum-shaped electrophotographic photosensitive member (photosensitive drum) formed of a rigid body having a diameter of 60 mm or less, which may require a simple drive mechanism and can be made compact with ease.

For the same purpose as the above, the intermediate transfer belt may be one which is placed over and around two rollers consisting of, e.g., a drive roller and a tension roller. This is preferred because the number of component parts can be cut down and the cartridge can be made more compact.

The tension roller, which applies tension to the intermediate transfer belt, must slide by at least 1 mm with respect to the direction of elongation of the intermediate transfer belt, in order to deal with any elongation of the intermediate transfer belt. In order for the intermediate transfer belt to be surely driven without slipping, the intermediate transfer belt may preferably be fitted over and around the two rollers at a force of 5 N or more.

As to the intermediate transfer belt, its resistivity must also be regulated. The intermediate transfer belt may have a volume resistivity of from $1\times10^{6}$ Ω·cm to $8\times10^{13}$ Ω·cm, within the range of which good images are obtainable. If it has a volume resistivity lower than $1\times10^{6}$ Ω·cm, no sufficient transfer electric field may be provided, tending to cause blank areas in images or coarse images. If on the other hand it has a volume resistivity higher than $8\times10^{13}$ Ω·cm, the transfer voltage must also be made higher, requiring a power source to be in a large size or resulting in a higher cost.

The intermediate transfer belt may also have a wall thickness in the range of from 40 μm to 300 μm. If it has a thickness smaller than 40 μm, it may lack in forming stability, tends to cause uneven thickness and may have insufficient durability and strength, where the belt may break or crack. If on the other hand it has a thickness larger than 300 μm, materials must be used in a large quantity, resulting in a high cost. Moreover, the intermediate transfer belt may have a large difference in peripheral speed between the inner surface and the outer surface of the belt at its part where it is put over the shaft of a printer or the like, tending to cause problems of, e.g., spots around line images due to the expansion and contraction of the outer surface. The belt may have a low flex durability or have so high a rigidity as to make the drive torque greater, requiring the main body to be in a large size or resulting in a higher cost. Such a problem also tends to occur.

In the present invention, the intermediate transfer belt and the electrophotographic photosensitive member are integrally supported to make up a cartridge, and it is sufficient for them to be combined when used by users. Taking into account readiness of handling in the course of manufacture and readiness of disassembly after recovery, it is preferred that they are so designed as to be divided into some smaller units, e.g., an intermediate transfer belt unit and an elecrophotographic photosensitive member unit.

There are no particular limitations on means by which the modulus of elasticity specified in the present invention is attained. Any resins used as a raw material for the intermediate transfer belt and various additives thereto may be selected so that the breaking extension and the modulus of elasticity at elongation from 0.5% to 06% may be regulated within the ranges of numerical values specified in the present invention.

For example, a filler such as inorganic particles may be mixed, whereby a reinforcing effect can be obtained and the modulus of elasticity can be enhanced. Here, the material and amount of the filler and a resin(s) may be so selected as to regulate the modulus of elasticity within the range specified in the present invention. Also, the filler may have a fibrous or plate-like shape, where a high reinforcing effect can be obtained even if the belt has elongated.

The intermediate transfer belt may also be produced by blending two or more kinds of resins having different breaking extensions and being not compatible with each other. Such a method is also effective. Where the intermediate transfer belt is produced using such materials, the respective resins are finely separated and present in the belt in a laminar or fibrous form. With the intermediate transfer belt thus produced, its strength, at the initial stage, arises from the resin having a small breaking extension. However, when creep is brought about over time and the resin having a small breaking extension exceeds its yield point, the belt's strength arises from the resin having a large breaking extension. Thus, the modulus of elasticity can be prevented from abruptly lowering.

There are no particular limitations on means by which the surface roughness of the intermediate transfer belt is regulated.

For example, a method is available in which regulation is effected in such a way that, when extrusion is carried out, resin materials are selected for melt properties and temperature conditions and cooling conditions at the time of extrusion are adjusted so that more smooth surface can be attained when an extruded product, melt-extruded into a film, is solidified from a molten state.

Other available methods include a method in which a product extruded into a belt is heated and a smooth form (for shaping) is applied thereto so as to have the same surface state as the form, and a method in which the surface of a belt is polished.

The process for producing the intermediate transfer belt may preferably be a production process which can produce a seamless belt and has a high production efficiency to enable cost saving. As a means therefor, a method is available in which an extrusion material is continuously melt extruded from a circular die and thereafter the product thus extruded is cut in a necessary length to produce a belt. Stated specifically, an intermediate transfer belt production process (called blown-film extrusion, or inflation) is preferred which comprises:

(1) a melt-extrusion step of melt-extruding an extrusion material from a circular die to obtain a tubular film;
(2) a diameter control step of blowing a gas into the tubular film having been melt-extruded through the melt-extrusion step, to regulate its internal volume to control the diameter of the tubular film;
(3) a tubular-film forming step of forming a tubular film having a diameter larger than the above circular die without using any member with which the tubular film is supported, until the tubular film having been melt-extruded through the melt-extrusion step and diameter-controlled through the diameter control step cools to solidify; and (4) a cutting step of cutting the tubular film having been formed through the tubular-film forming step.

The tubular film having been formed through the tubular-film forming step may also preferably have a wall thickness which is ⅓ or less, and more preferably ⅕ or less, with respect to the slit width of the circular die. This value represents the stretched state of the material. If the tubular film has a wall thickness which is larger than ⅓ with respect to the slit width of the circular die, the material may insufficiently stretch and may cause difficulties due to its low strength, uneven resistance and uneven thickness.

The tubular film having been formed through the tubular-film forming step may also preferably have a diameter (outer diameter of the tubular film) which is from 50% to 400%, and more preferably from 101% to 300%, with respect to the diameter of the circular die (outer diameter of the slit of the circular die). If it is more than 400%, the film has been stretched in excess in the peripheral direction, and if it is less than 50%, the film has been stretched almost in the flow direction (extrusion direction), resulting in low extrusion stability or making it difficult to ensure the thickness and strength necessary for obtaining the effect of the present invention.

An example of the process for producing the intermediate transfer belt used for the process cartridge of the present invention is described below. It should be noted that the present invention is by no means limited to this example.

Figure 3:
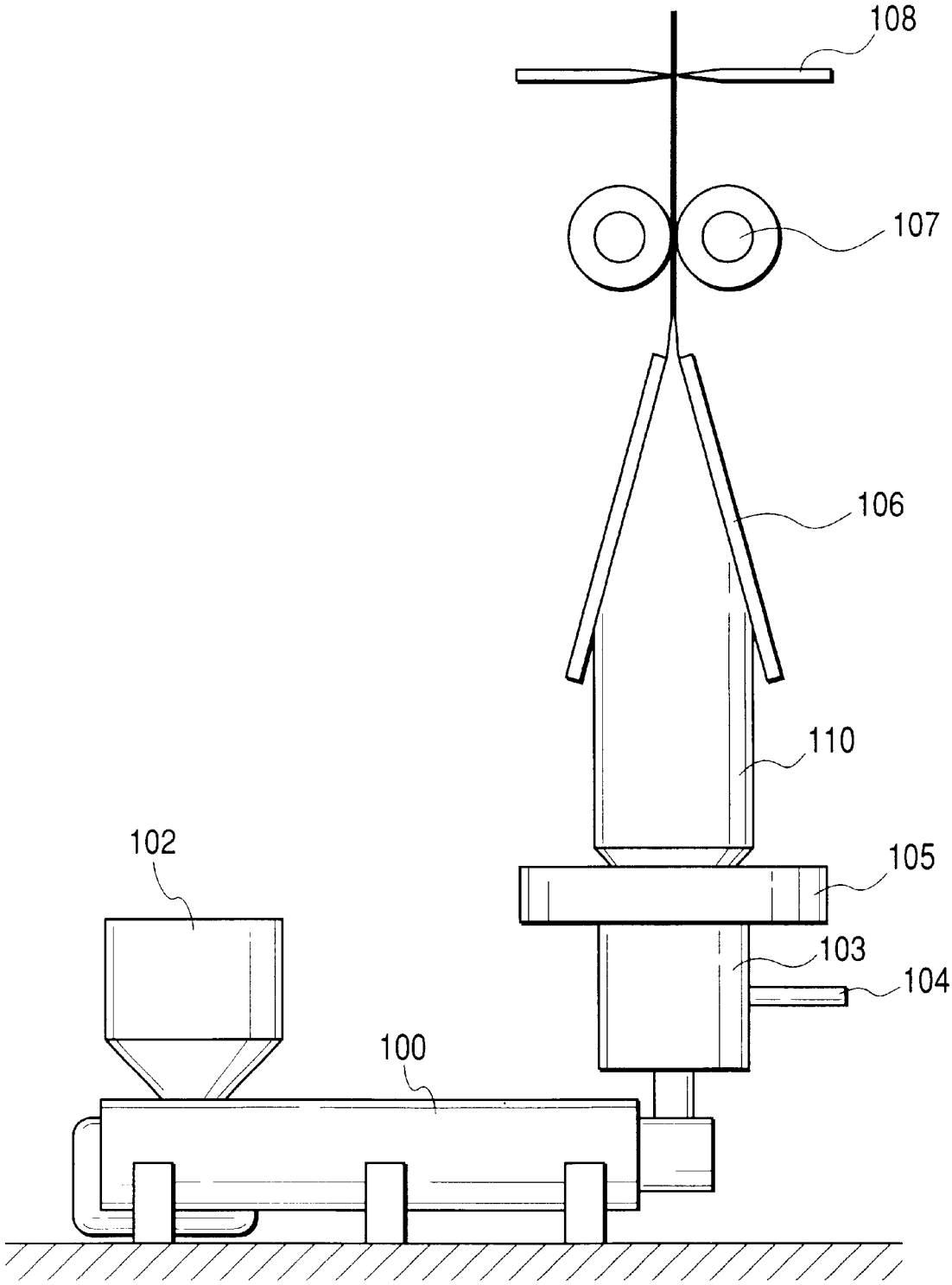
FIG. 3 is a view showing an example of a production apparatus for producing an intermediate transfer belt (single layer).

FIG. 3 shows an example of an appratus for producing the intermediate transfer belt used in the process cartridge of the present invention. This production apparatus consists chiefly of an extruder 100, an extruder die 103, and a gas blowing unit having a gas inlet passage 104.

First, an extrusion resin, a conducting agent and additives are premixed under the desired formulation and thereafter kneaded and dispersed to prepare an extrusion material, which is then put into a hopper 102 installed in the extruder 100.

The extruder 100 has a preset temperature, extruder screw construction and so forth which have been so selected that the extrusion material may have a melt viscosity necessary for the extrusion into a belt in the subsequent step and the materials can be dispersed uniformly one another. The extrusion material is melt-kneaded in the extruder 100 into a melt, which then enters a circular die 103.

The circular die 103 is provided with a gas inlet passage 104. Through the gas inlet passage 104, a gas is blown into the circular die 103, whereupon the melt having passed through the circular die 103 in a tubular form inflates while scaling up in the diametrical direction.

The gas to be blown here may be air, and besides, may be selected from nitrogen, carbon dioxide and argon.

The extruded product having thus inflated is drawn upward while being cooled by an outside-cooling ring 105, and formed into a tubular film 110. Usually, in such a blown-film extrusion apparatus, a method is employed in which the tubular film 110 is pressed forcibly from the right and the left by means of stabilizing plates 106 to fold it into a sheet, and then drawn off at a constant speed while being so sandwiched with pinch rollers 107 that the air in the interior does not escape. Then, the film 110 thus drawn off is cut with a cutter 108 to obtain a tubular film with the desired size.

Next, this tubular film is worked using a form (for shaping) in order to regulate its surface smoothness and size and to remove any folds made in the film at the time of draw-off.

Stated specifically, a method is usable which makes use of a pair of cylindrical forms which are made of materials which are different from each other in coefficient of thermal expansion and diameter.

In this method, a small-diameter cylindrical form (inner form) is so made as to have a coefficient of thermal expansion larger than the coefficient of thermal expansion of a large-diameter cylindrical form (inner form). A tubular film obtained by extrusion is placed over this inner form. Thereafter, the inner form with film is inserted into the outer form so that the tubular film is held between the inner form and the outer form. A gap between the inner form and the outer form may be determined by calculation on the bases of heating temperature, difference in coefficient of thermal expansion between the inner form and the outer form, and pressure required.

The form set having in this order the inner form, the tubular film and the outer form is heated to the vicinity of the softening point temperature of resin. As a result of the heating, the inner form, having a larger coefficient of thermal expansion, expands more than the outer form and a uniform pressure is applied to the whole tubular film (resin film). Here, the surface of the resin film having reached the vicinity of its softening point is pressed against the inner surface of the outer form having been worked smoothly, so that the smoothness of the surface of the resin film is improved. Thereafter, these are cooled and the film is removed from the forms, thus obtaining a film with smooth surface characteristics.

Thereafter, this tubular film is optionally fitted with a reinforcing member, a guide member and a position detection member, and is precisely cut to produce the intermediate transfer belt.

Figure 4:
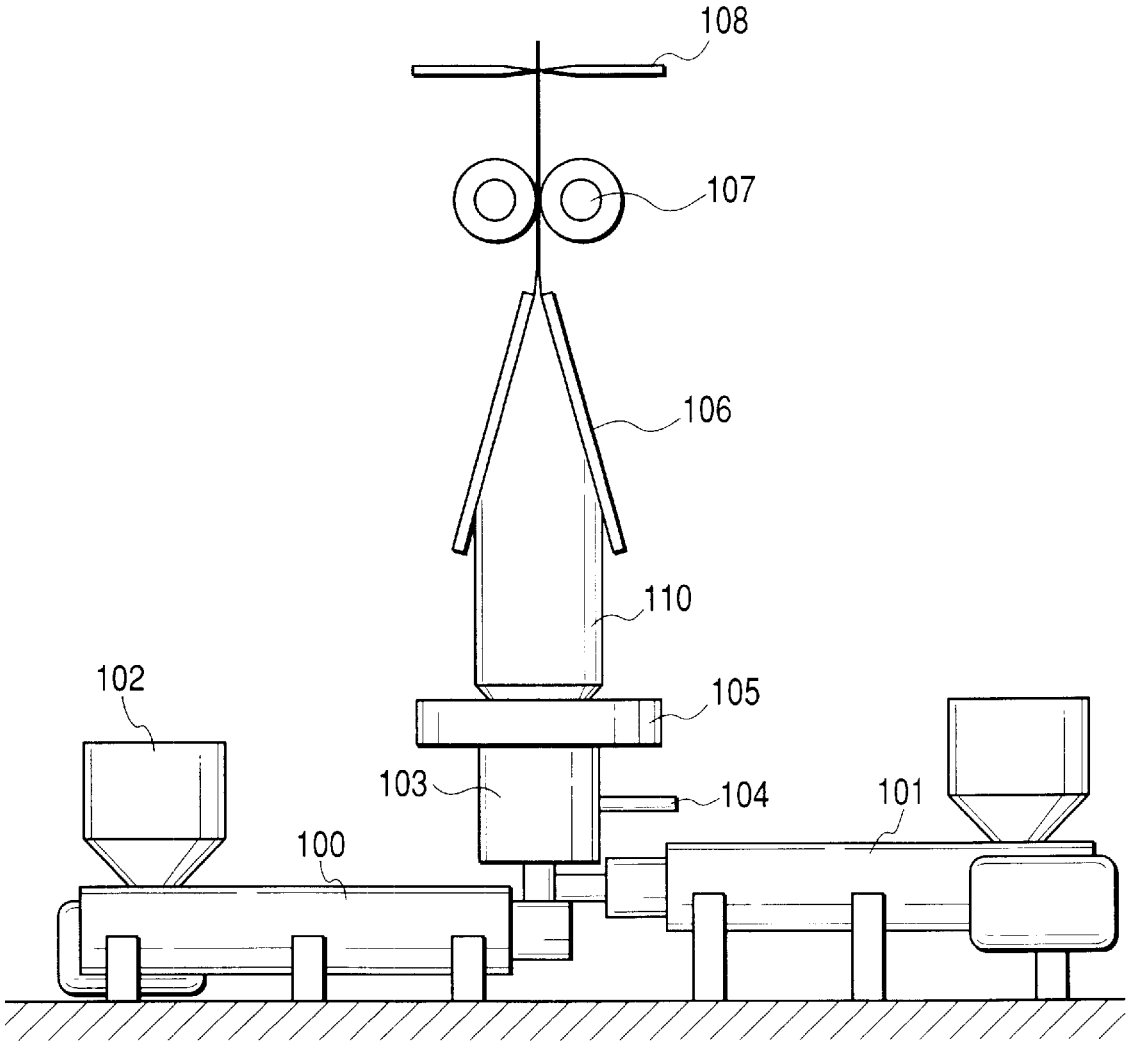
FIG. 4 is a view showing an example of a production apparatus for producing an intermediate transfer belt (double layer).

The foregoing description relates to a single-layer belt. In the case of a belt of double-layer construction, an extruder 101 is additionally provided as shown in FIG. 4. Simultaneously with the kneaded melt held in the extruder 100, a kneaded melt in the extruder 101 is sent to a double-layer circular die 103, and the two layers are scale-up inflated simultaneously, thus obtaining a double-layer belt.

In the case of triple- or more layer construction, the extruder may of course be provided in a number corresponding to the number of layers.

Thus, the above intermediate transfer belt production process makes it possible to extrude not only intermediate transfer belts of single-layer construction but also those of multi-layer construction in a good dimensional precision through a series of steps and in a short time. That the etrusion can be made in a short time means that mass production and low-cost production can be made.

The resin which is a chief material among extrusion materials used in the intermediate transfer belt for the process cartridge of the present invention may be any of those which can satisfy the intermediate transfer belt characteristics according to the present invention, without any particular limitation. It is preferable to use at least one of, e.g., olefin resins such as polyethylene and polypropylene, polystyrene resins, acrylic resins, polyester resins, polycarbonate, sulfur-containing resins such as polysulfone, polyether sulfone and polyphenylene sulfide, fluorine-containing resins such as polyvinylidene fluoride and a polyethylene-tetrafluoroethylene copolymer, polyurethane resins, silicone resins, ketone resins, polyvinylidene chloride, thermoplastic polyimide resins, polyamide resins, modified polyphenylene oxide resins, and various modified resins or copolymers of any of these. However, examples are by no means limited to the above materials.

Then, there are no particular limitations on the additives which may be mixed in order to regulate the electrical resistance value of the intermediate transfer belt for the process cartridge of the present invention. As a conductive filler for regulating the resistance, it includes carbon black and various conductive metal oxides. As a non-filler type resistance regulator, it includes low-molecular weight ion conducting materials such as various metal salts and glycols, antistatic resins containing an ether linkage or a hydroxyl group in the molecule, and organic polymeric compounds showing electroconductivity.

What is required here is the dispersion state of the components of the intermediate transfer belt, such as the various additives and the resin. If agglomeration of particles or extreme separation of some components occurs, it is difficult to obtain the effect of the present invention. It is important to select materials and dispersion means.

Then, an example of an electrophotographic apparatus making use of the intermediate transfer belt/electrophotographic photosensitive member integral cartridge of the present invention is shown in FIG. 1.

The apparatus shown in FIG. 1 is a color electrophotographic apparatus such as a color copying machine or a color laser beam printer.

Reference numeral 1 denotes a rotating-drum type electrophotographic photosensitive member (photosensitive drum) serving as a first image-bearing member, which is rotatably driven at a prescribed peripheral speed (process speed) in the clockwise direction shown by an arrow.

The electrophotographic photosensitive member 1 is, in the course of its rotation, uniformly electrostatically charged to a prescribed polarity and potential by means of a primary-charging means (charging roller) 2. Reference numeral 32 denotes a power source of the primary-charging means 2. Here, a voltage formed by superimposing an AC voltage on a DC voltage is applied. Alternatively, only an AC voltage may be applied.

Then, the electrophotographic photosensitive member is exposed to light 3 by an exposure means (not shown; e.g., a color-original image color-separating/image-forming optical system, or a scanning exposure system comprising a laser scanner that outputs laser beams modulated in accordance with time-sequential electrical digital pixel signals of image information). Thus, an electrostatic latent image is formed which corresponds to a first color component image (e.g., a yellow color component image) of the intended color image.

Next, the electrostatic latent image is developed with a first-color yellow toner Y by means of a first developing means (yellow color developing assembly 41). At this stage, second to fourth developing means (magenta (M) color developing assembly 42, cyan (C) color developing assembly 43 and black (BK) color developing assembly 44) each stand unoperated and do not act on the electrophotographic photosensitive member 1, and hence the first-color yellow toner image is not affected by the second to fourth developing assemblies.

An intermediate transfer belt 5 is rotatively driven in the clockwise direction at the same peripheral speed as that of the electrophotographic photosensitive member 1.

While the first-color yellow toner image formed and held on the electrophotographic photosensitive member 1 passes through a nip formed between the electrophotographic photosensitive member 1 and the intermediate transfer belt 5, it is successively primarily transferred to the periphery of the intermediate transfer belt 5 by the aid of an electric field formed by a primary-transfer bias applied to the intermediate transfer belt 5 through a roller-shaped primary-transfer means (primary-transfer roller) 6.

The electrophotographic photosensitive member 1 surface from which the first-color yellow toner image has been transferred is cleaned by a cleaning means 13.

Subsequently, the second-color magenta toner image, the third-color cyan toner image and the fourth-color black toner image are sequentially similarly transferred and superimposed onto the intermediate transfer belt 5. Thus, the intended synthesized color toner image is formed.

Reference numeral 7 denotes a secondary-transfer means (secondary-transfer roller), which is provided in such a way that it is axially supported in parallel to a drive roller 8 and stands separable from the bottom surface of the intermediate transfer belt 5.

The primary-transfer bias for sequentially superimposition-transferring the first- to fourth-color toner images from the electrophotographic photosensitive member 1 to the intermediate transfer belt 5 is applied from a bias source 30 in a polarity (+) reverse to that of each toner. The voltage thus applied is, e.g., in the range of from +100 V to +2 kV.

In the step of primary transfer of the first- to third-color toner images from the electrophotographic photosensitive member 1 to the intermediate transfer belt 5, the secondary-transfer means 7 may also be set separable from the intermediate transfer belt 5.

The synthesized color toner images transferred onto the intermediate transfer belt 5 are transferred to a second image-bearing member, transfer medium P, in the following way: The secondary-transfer means 7 is brought into contact with the intermediate transfer belt 5 and simultaneously the transfer medium P is fed at a prescribed timing from a paper feed roller 11 through a transfer medium guide 10 until it reaches a contact zone formed between the intermediate transfer belt 5 and the secondary-transfer means 7, where a secondary-transfer bias is applied to the secondary-transfer means 7 from a bias power source 31. By the aid of this secondary-transfer bias, the synthesized color toner images are secondarily transferred from the intermediate transfer belt 5 onto the second image-bearing member, transfer medium P. The transfer medium P to which the toner images have been transferred is guided into a fixing means 15 and heat-fixed.

After the toner images have been transferred to the transfer medium P, a charge-providing means 9 placed in a touchable and separable state is brought into contact with the intermediate transfer belt 5, and a bias with a polarity reverse to that of the electrophotographic photosensitive member 1 is applied, whereupon electric charges with a polarity reverse to that at the time of primary transfer are imparted to toners not transferred to the transfer medium P and remaining on the intermediate transfer belt 5 (i.e., transfer residual toners). Reference numeral 33 denotes a bias power source. Here, a voltage formed by superimposing an AC voltage on a DC voltage is applied.

The transfer residual toners charged to a polarity reverse to that at the time of primary transfer are electrostatically transferred to the electrophotographic photosensitive member 1 at the zone coming into contact with the electrophotographic photosensitive member 1 and the vicinity thereof. Thus, the intermediate transfer belt 5 is cleaned. This step can be carried out simultaneously with the primary transfer, and hence does not cause any lowering of throughput.

Subsequently, the intermediate transfer belt/electrophotographic photosensitive member integral cartridge of the present invention is described.

Figure 2:
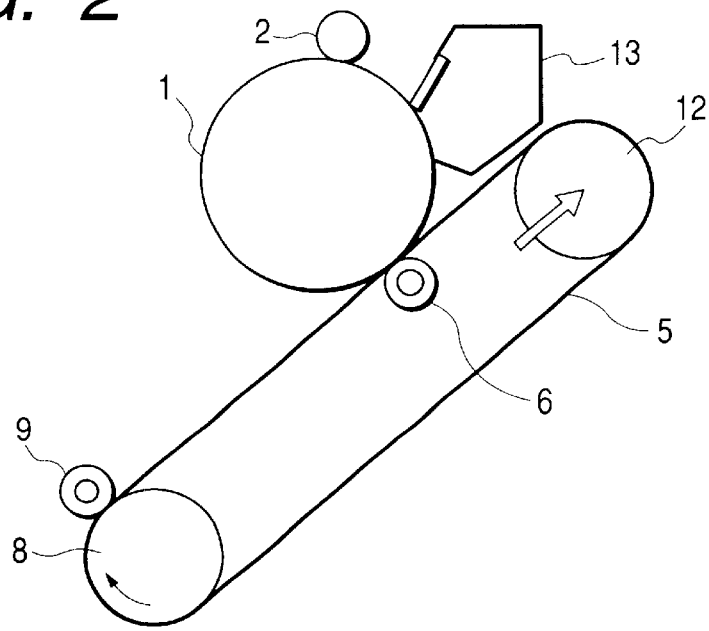
FIG. 2 is a schematic sectional view showing the construction of the process cartridge of the present invention.

The process cartridge of the present invention is, as shown in FIG. 2, so constructed that at least an electrophotographic photosensitive member 1, an intermediate transfer belt 5, a primary-transfer means 6 and a charge-providing means 9 are integrally supported so that it is detachably mountable to the main body of the electrophotographic apparatus.

The process cartridge may also be so constructed that at least one means among means the electrophotographic apparatus has, such as an electrophotographic-photosensitive-member cleaning means, a primary-charging means and a waste-toner container, can further be incorporated in the intermediate transfer belt/electrophotographic photosensitive member integral cartridge, or that the electrophotographic apparatus can be provided with such means as the electrophotographic-photosensitive-member cleaning means, the primary-charging means and the waste-toner container when such a process cartridge is mounted on the electrophotographic apparatus.

The cleaning mechanism for the intermediate transfer belt in the present invention is, as described previously, necessary for the transfer residual toners to be charged to a polarity reverse to that at the time of primary transfer and thereby returned to the electrophotographic photosensitive member at the primary-transfer zone. In the cartridge shown in FIG. 2, a charge-providing means (intermediate-transfer-belt cleaning roller) 9 comprised of a medium-resistance elastic body is provided for the cleaning mechanism.

As for the cleaning of the electrophotographic photosensitive member, it may preferably be blade cleaning making use of an elastic blade. In the process cartridge shown in FIG. 2, a waste-toner container (not shown) is also integrally provided so that the transfer residual toners on both the intermediate transfer belt and the electrophotographic photosensitive member may simultaneously be discarded when the cartridge is replaced. Thus, it contributes to an improvement in maintenance performance.

The intermediate transfer belt is also placed over and around two rollers, a drive roller 8 and a tension roller 12, so that the number of component parts can be made small and the cartridge can be made compact. Here, the roller 8 is a drive roller and at the same time an opposing roller of the charge-providing means (intermediate-transfer-belt cleaning roller).

The tension roller 12, which rotates following the intermediate transfer belt, has a sliding mechanism, and is brought into pressure contact with the inside of the belt in the direction of an arrow by the action of a compression spring to impart a tension to the intermediate transfer belt. It may be slidable in a slide width of from 1 mm to 5 mm, and may apply a spring pressure of from 5 N to 200 N in total.

The electrophotographic photosensitive member 1 and the drive roller 8 may also have a coupling (not shown) so that the rotational drive force may be transmitted from the main body.

Methods of measuring various physical properties concerning the present invention are shown below.

Measurement of Modulus of Elasticity and Breaking Extension:

A measuring sample is prepared in a size 20 mm wide and 100 mm long, which is cut from the intermediate transfer belt in the peripheral direction. Its thickness is measured and thereafter the sample is set on a tensile tester (TENSILON RTC-1250A, manufactured by Orientec Co.). The thickness is measured as an average at five spots. A tensile test is made at a measurement distance of 50 mm and a tensile speed of 5 mm/min, and elongation and stress are recoded in a recorder, where stress at elongation of 0.5% and 0.6% each is read. The modulus in tension is calculated according to the following equation.

This measurement is made five times, and the value of an average therefrom is the modulus of elasticity referred to in the present invention.

$$\text{Modulus of elasticity (MPa)}=(f\mathbf{2}-f\mathbf{1})/(20\times t)\times 1{,}000.$$

In the equation, f1 represents stress at 0.5% elongation (N); f2, stress at 0.6% elongation (N); and t, thickness (mm) of the sample.

To measure the breaking extension, a test piece having the same form is pulled by using the same tester as in the above measurement of modulus of elasticity, except that the tensile speed is changed to 50 mm/min. Displacement L (mm) from the start of measurement at the breaking point is recorded, and is calculated according to the following equation.

This measurement is made five times, and the value of an average therefrom is the breaking extension referred to in the present invention.

$$\text{Breaking extension (\%)}=L/50\times 100.$$

Measurement of Surface Roughness:

This measurement is made according to JIS B0601.

Measurement of Volume Resistivity:

As to measuring instruments, an ultra-high resistance meter R8340A (manufactured by Advantest Co.) is used as a resistance meter, and Sample Box TR42 for ultra-high resistance measurement (manufactured by Advantest Co.) is used as a sample box., The main electrode is 25 mm in diameter, and the guard-ring electrode is 41 mm in inner diameter and 49 mm in outer diameter.

A sample is prepared in the following way.

First, the intermediate transfer belt is cut in a circular form of 56 mm in diameter by means of a punching machine or a sharp knife. The circular cut piece obtained is fitted, on its one side, with an electrode over the whole surface by forming a Pt-Pd deposited film and, on the other side, fitted with a main electrode of 25 mm in diameter and a guard electrode of 38 mm in inner diameter and 50 mm in outer diameter by forming Pt-Pd deposited films. The Pt-Pd deposited films are formed by carrying out vacuum deposition for 2 minutes using Mild Sputter E1030 (manufactured by Hitachi Ltd.). The one on which the vacuum deposition has been completed is used as a measuring sample.

Measurement is conducted in a measurement atmosphere of 23° C./55%RH. The measuring sample is previously left standing in the like atmosphere for 12 hours or longer. Measurement is made under a mode of discharge for 10 seconds, charge for 30 seconds and measurement for 30 seconds and at an applied voltage of 1,000 V.

Measurement of Thickness:

Thickness unevenness of the intermediate transfer belt of the present invention is measured with a dial gauge measurable by 1 $\mu$m as a minimum value, over the whole periphery of the belt at points 50 mm apart from both ends and, with respect to the middle, at four points at equal intervals in the peripheral direction. Measurements at 12 points in total for each intermediate transfer belt are averaged.

The present invention is described below in greater detail by giving specific Examples. In the following Examples, "part(s)" means "part(s) by weight".

In the first place, a process cartridge used in Examples and Comparative Examples is described.

Figure 5:
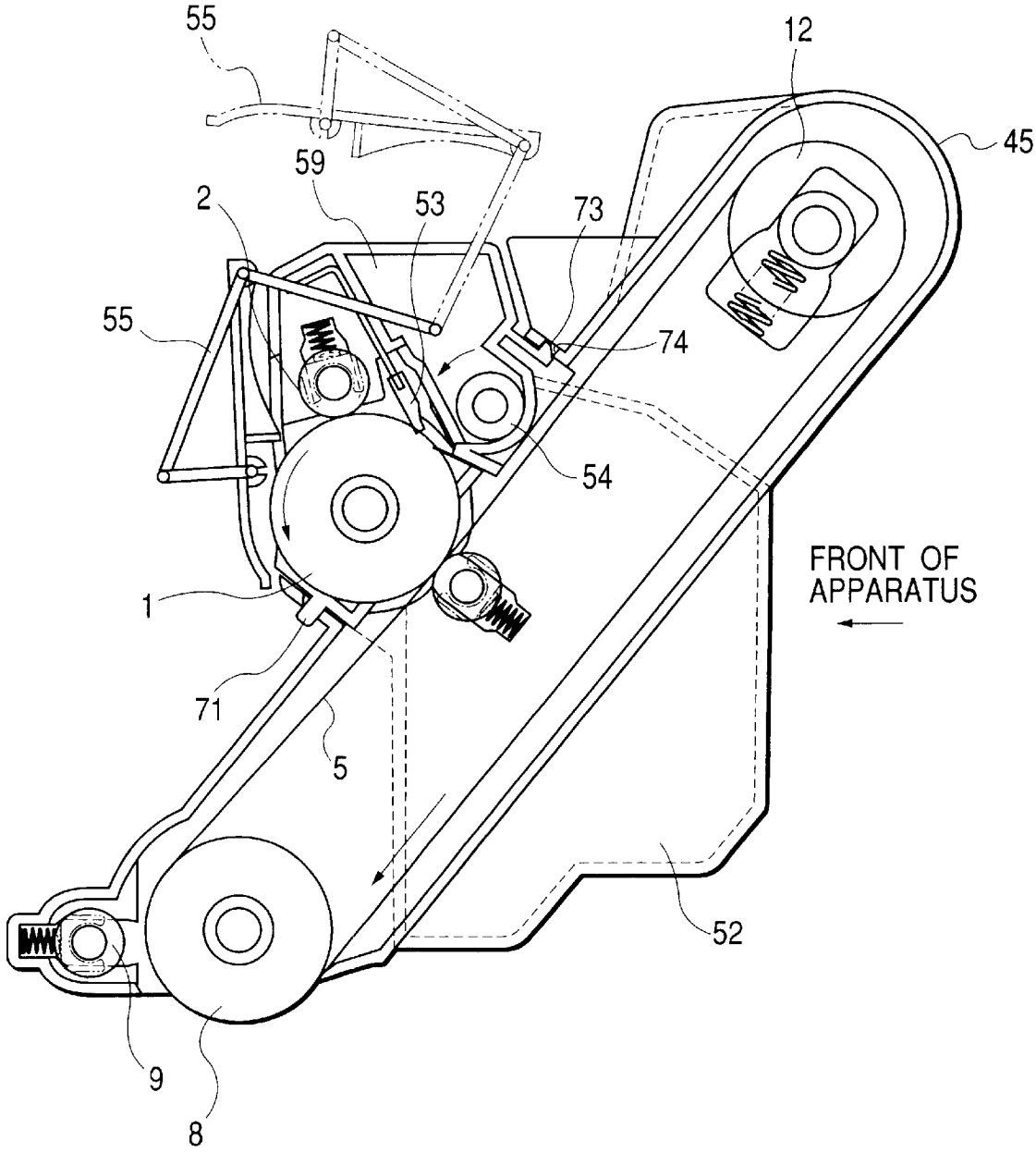
FIG. 5 is a schematic view showing the construction of a process cartridge comprising an electrophotographic photosensitive member unit and an intermediate transfer belt unit which are joined to each other, used in Examples and Comparative Examples.

FIG. 5 schematically illustrates the construction of a process cartridge comprising an electrophotographic photosensitive member unit having an electrophotographic photosensitive member and an intermediate transfer belt unit having an intermediate transfer belt which are joined together.

Figure 6:
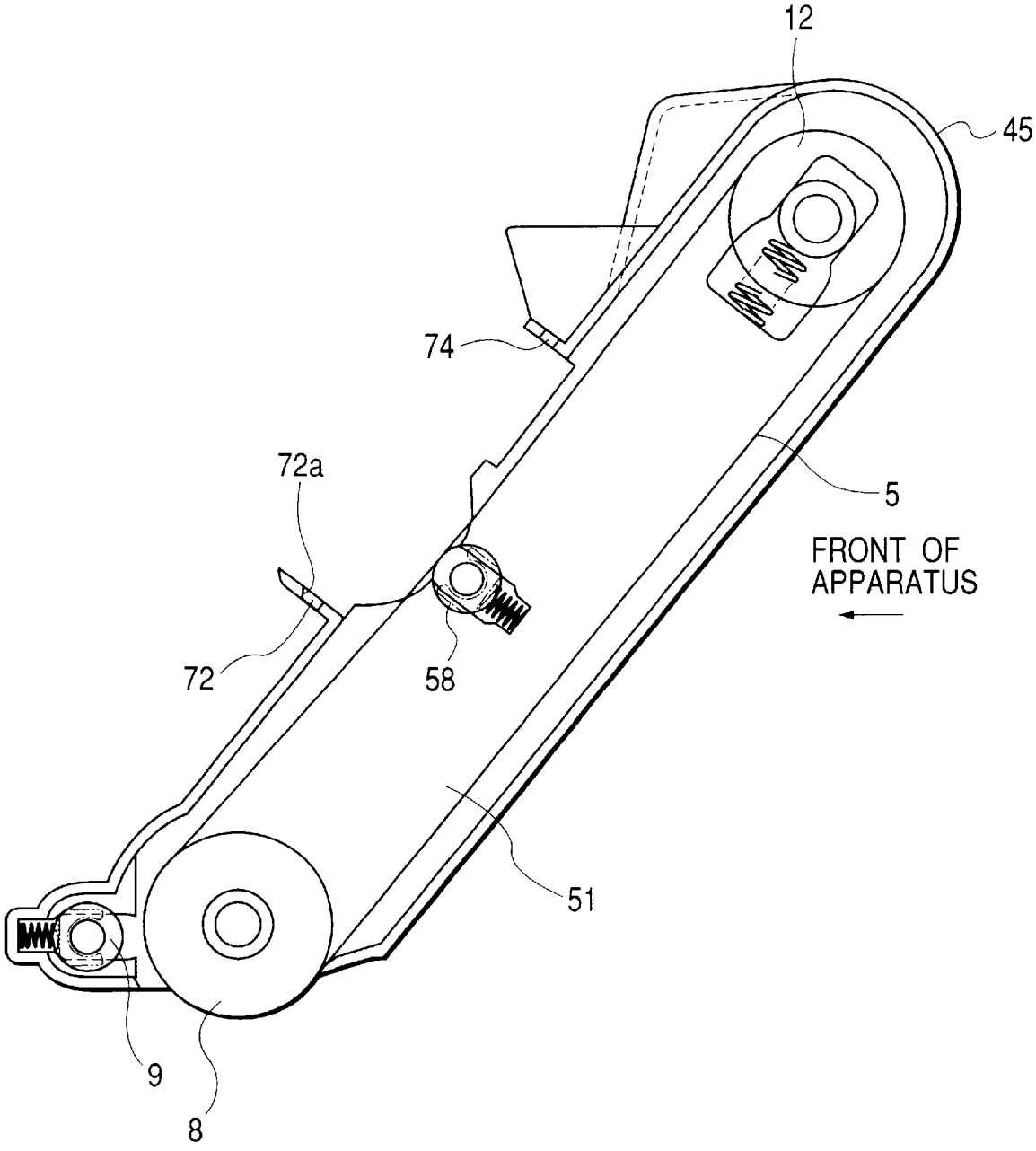
FIG. 6 is a schematic view showing the construction of the intermediate transfer belt unit.
Figure 7:
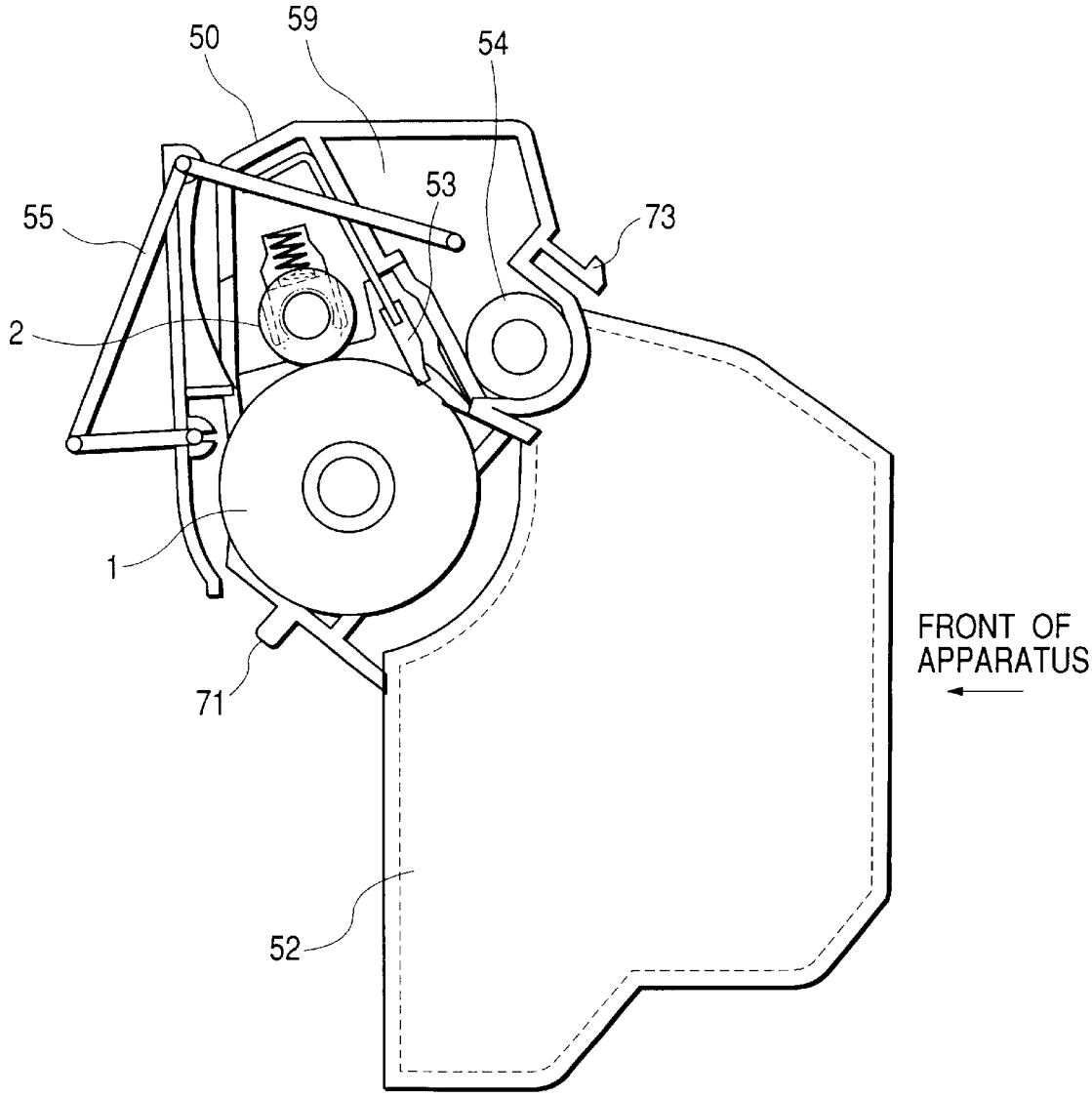
FIG. 7 is a schematic view showing the construction of the electrophotographic photosensitive member unit.

FIGS. 6 and 7 schematically illustrate the construction of the intermediate transfer belt unit and the electrophotographic photosensitive member unit, respectively.

Frame construction of the process cartridge is roughly divided into two parts: an electrophotographic photosensitive member frame 59 constructed integrally with a waste-toner container 52, shown in FIGS. 5 and 7, and an intermediate transfer belt frame 45 shown in FIGS. 5 and 6. The former comprises an electrophotographic photosensitive member unit constituted of an electrophotographic photosensitive member 1, a charging roller 2, a cleaning blade 53, a screw 54 and a drum shutter 55 as chief component parts. The latter comprises an intermediate transfer belt unit 51 having i) an intermediate transfer belt 5 which is put over and around a drive roller 8 and a follower roller (tension roller) 12, ii) a primary-transfer roller 58 provided on the inside of the intermediate transfer belt at its part facing the electrophotographic photosensitive member 1 and iii) a charge-providing means (intermediate-transfer-belt cleaning roller) 9 provided at the drive roller 8.

These two units are joined in such a way that projections 71 provided at both ends of the electrophotographic photosensitive member frame 59 are respectively inserted into registration holes 72 provided in the intermediate transfer belt frame 45 and that a hook 73 at a snap-fitting hooking part provided at the middle in the width direction of the electrophotographic photosensitive member frame 59 is fitted into a lock hole 74 of the intermediate transfer belt frame 45.

Here, the registration holes 72 and the lock hole 74 provided in the intermediate transfer belt frame 45 are made a little larger by a certain extent than the projections 71 and hook 73 provided on the electrophotographic photosensitive member frame 59, and the electrophotographic photosensitive member unit 50 and the intermediate transfer belt unit 51 are so constructed that relative positional movement to a certain extent is allowable between them.

The registration holes 72 are each provided with a taper 72*a* so that the unit can be attached or detached with ease.

In the process cartridge shown in FIG. 5, the hook 73 of the electrophotographic photosensitive member unit 50 may be pushed to be unhooked from the lock hole 74 of the intermediate transfer belt unit 51, and the electrophotographic photosensitive member unit 50 may be turned around. Thus, the process cartridge can be divided into the electrophotographic photosensitive member unit and the intermediate transfer belt unit as shown in FIGS. 6 and 7.

When joined, contrary to the foregoing, the projections 71 of the electrophotographic photosensitive member unit 50 can be inserted into the registration holes 72 of the intermediate transfer belt unit 51, and the electrophotographic photosensitive member unit 50 can be turned around in the direction opposite to that at the time of detachment to push the hook 73 into the lock hole 74, thereby joining the two units.

Figure 8:
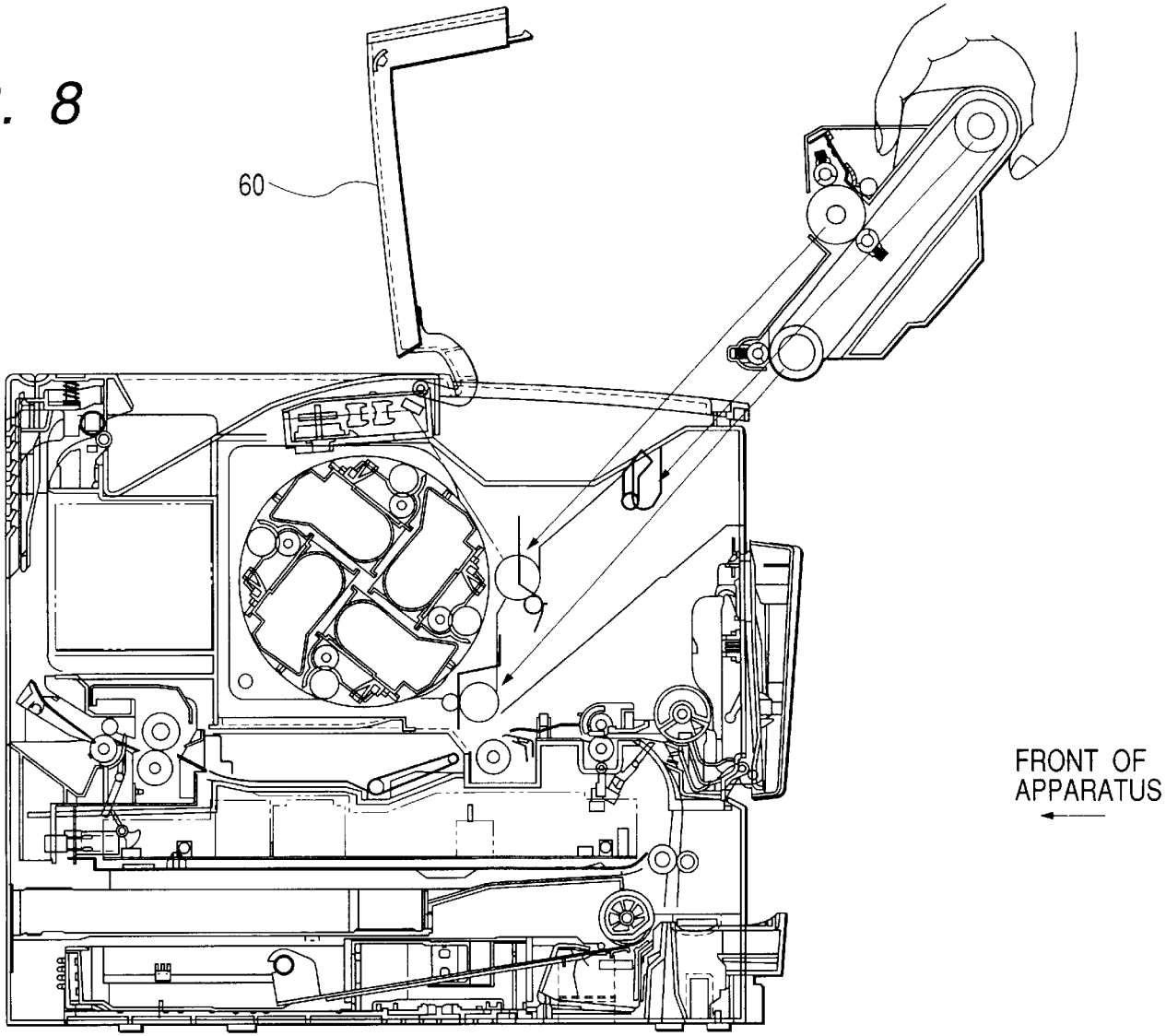
FIG. 8 is a view showing how the process cartridge of the present invention is attached to or detached from the electrophotographic apparatus.

FIG. 8 illustrates how the process cartridge of the present invention is attached to or detached from the electrophotographic apparatus.

Only a top cover 60 of the electrophotographic apparatus main body can be opened to attach or detach the process cartridge simply as in conventional black-and-white laser beam printers. Thus, maintenance operations, such as the handling of paper jamming and the replacement of the process cartridge, can be performed with ease.

EXAMPLE 1

Production of Intermediate Transfer Belt:

| | |
|---|---|
| PVDF (polyvinylidene fluoride resin) | 100 parts |
| Polyether-containing antistatic resin | 14 parts |

In the above formulation, the antistatic resin was so selected as to have a larger elongation than the PVDF and not to be completely compatible with the PVDF. These materials were melt-kneaded at 210° C. by means of a twin-screw extruder to be mixed with each other, and the mixture obtained was extruded in the shape of a strand of about 2 mm in diameter, followed by cutting into pellets. This is used as an extrusion material.

Next, in the extrusion apparatus shown in FIG. 3, the extruder die 103 was set as a single-layer circular die, and one having a die slit outer diameter of 100 mm was used. The slit of the circular die was 0.8 mm in width.

The above extrusion material, having been sufficiently dried by heating, was put into the hopper 102 of this extrusion apparatus, and heated and melted. The molten product was extruded at 210° C. from the circular die 103. The outside-cooling ring 105 was provided around the circular die 103, and air was blown from the circumference to the film extruded in a tubular form to effect cooling.

Air is also blown to the interior of the extruded tubular film through the gas inlet passage 104 to cause the film to inflate while scaling up to a diameter of 140 mm. Thereafter, the film was continuously drawn off at a constant speed by means of the draw-off unit. Here, the air was stopped being fed at the time the diameter became the desired value.

Subsequently to the draw-off through the pinch rollers, the tubular film was cut with the cutter 108. The film was cut in a length of 310 mm after its thickness became stable to form six tubular films.

For these tubular films, their size and surface smoothness were regulated and folds were removed, using the pair of cylindrical forms made of metals which are different from each other in coefficient of thermal expansion.

The tubular film was placed over the inner form, having a higher coefficient of thermal expansion, and this inner form with the film was inserted into the outer form having been worked to have a smooth inner surface, followed by heating at 170° C. for 20 minutes.

After cooling, the tubular films were removed from these cylindrical forms, and their ends were cut away, and thus six intermediate transfer belts of 140 mm in outer diameter were produced. One of these was fitted with a meandering preventive member so as to be used for image examination.

Measurement of Physical Properties:

Five belts among these intermediate transfer belts were left standing for 3 days in an environment of 23° C. and 55%RH, and their physical properties were measured.

First, a sample for measuring the modulus of elasticity was one by one cut from each intermediate transfer belt, and the modulus of elasticity was measured by the measuring method described previously, where the values obtained from the five belts were averaged. As a result, the modulus of elasticity at elongation from 0.5% to 0.6% of this intermediate transfer belt was found to be 815 MPa.

Samples were prepared in the same way to measure other properties to find that this belt had a breaking extension of 20%, a surface roughness Ra of 0.03 μm, a thickness of 102 μm and a volume resistivity of $7.8\times10^{10}$ Ω·cm.

Image Evaluation:

The remaining one belt, not used for the measurement of physical properties, among the six intermediate transfer belts produced as described above was incorporated in the intermediate transfer belt/electrophotographic photosensitive member integral cartridge constructed as described above. Here, the spring pressure of the tension roller was 20 N in total for the right and the left in an extent of slide of 2.5 mm. The tension roller and the drive roller were each of a diameter of 28 mm. As the electrophotographic photosensitive member, a photosensitive drum comprising an aluminum cylinder of 47 mm in diameter and a photosensitive layer formed thereon was used.

Subsequently, for an acceleration test, this process cartridge was left standing in a high-temperature environment of 40° C. for 14 days. Thereafter, this cartridge was allowed to stand still in an environment of 23° C. and 55%RH for 12 hours, and then set in the electrophotographic apparatus constructed as shown in FIG. 1, to test full-color image reproduction on 80 g/m$^2$ paper in the same environment.

The exposure means used here was a digital exposure means by which electrostatic latent images were formed on the surface of the electrophotographic photosensitive member by a digital (laser) system with a resolution of 600 dpi.

Images obtained were visually evaluated, where good full-color images free of any problems such as color misregistration, uneven density and blank areas caused by poor transfer were obtained.

Subsequently, a continuous 5,000-sheet printing test was made at a printing speed of 4 sheets per minute, where the same good images as those at the initial stage were obtained. Thus, it was ascertained that the process cartridge, in which the intermediate transfer belt and the electrophotographic photosensitive member were integrally supported, that was produced as described above, had good performance.

The results of measurement and evaluation are shown in Table 1.

EXAMPLE 2

Six intermediate transfer belts were produced in the same manner as in Example 1 except that the mixing materials were changed as shown below.

| | |
|---|---|
| PVDF | 100 parts |
| Polyether-containing antistatic resin | 8 parts |
| Sulfonate type surface-active agent | 4 parts |

For the resultant intermediate transfer belts, physical properties were measured in the same manner as in Example 1. As a result, the modulus of elasticity at elongation from 0.5% to 0.6% of this intermediate transfer belt was found to be 585 MPa; the breaking extension, 680%; the surface roughness Ra, 0.04 μm; the thickness, 100 μm; and the volume resistivity, $8.3\times10^{9}$ Ω·cm.

Using this process cartridge in which the intermediate transfer belt and the electrophotographic photosensitive member were integrally supported, image printing was also tested in the same manner as in Example 1 to obtain results as good as those in Example 1.

The results of measurement and evaluation are shown in Table 1.

EXAMPLE 3

Six intermediate transfer belts were produced in the same manner as in Example 1 except that the mixing materials were changed as shown below and the kneading temperature, the extrusion temperature and the form-heating temperature were each raised to 260° C. in conformity with the resin.

| | |
|---|---|
| Polycarbonate resin | 100 parts |
| Inorganic metal salt | 1.5 parts |

For the resultant intermediate transfer belts, physical properties were measured in the same manner as in Example 1. As a result, the modulus of elasticity at elongation from 0.5% to 0.6% of this intermediate transfer belt was found to be 2,300 MPa; the breaking extension, 56%; the surface roughness Ra, 0.08 μm; the thickness, 100 μm; and the volume resistivity, $2.2\times10^{9}$ Ω·cm.

Using this process cartridge in which the intermediate transfer belt and the electrophotographic photosensitive member were integrally supported, image printing was also tested in the same manner as in Example 1 to obtain results as good as those in Example 1.

The results of measurement and evaluation are shown in Table 1.

EXAMPLE 4

Six intermediate transfer belts were produced in the same manner as in Example 1 except that the mixing materials were changed as shown below, and the kneading temperature, the extrusion temperature and the form-heating temperature were each raised to 260° C. in conformity with the resin and, in the finishing step making use of forms, the outer form was so changed as to have a little greater inner-surface roughness.

| | |
|---|---|
| Polycarbonate resin | 100 parts |
| Conductive carbon black | 25 parts |

For the resultant intermediate transfer belts, physical properties were measured in the same manner as in Example 1. As a result, the modulus of elasticity at elongation from 0.5% to 0.6% of this intermediate transfer belt was found to be 2,500 MPa; the breaking extension, 38%; the surface roughness Ra, 0.5 μm; the thickness, 108 μm; and the volume resistivity, $2.5\times10^{8}$ Ω·cm.

Using this process cartridge in which the intermediate transfer belt and the electrophotographic photosensitive member were integrally supported, image printing was also tested in the same manner as in Example 1 to obtain results judged to be, though slightly coarse images were seen, permissible in practical use.

The results of measurement and evaluation are shown in Table 1.

COMPARATIVE EXAMPLE 1

Six intermediate transfer belts were produced in the same manner as in Example 1 except that the mixing materials were changed as shown below.

| | |
|---|---|
| PVDF | 100 parts |
| Polyether-containing antistatic resin | 30 parts |
| Fluorine type surface-active agent | 4 parts |

For the resultant intermediate transfer belts, physical properties were measured in the same manner as in Example 1. As a result, the modulus of elasticity at elongation from 0.5% to 0.6% of this intermediate transfer belt was found to be 450 MPa; the breaking extension, 880%; the surface roughness Ra, 0.04 μm; the thickness, 99 μm; and the volume resistivity, $3.1\times10^{9}$ Ω·cm.

Using this process cartridge in which the intermediate transfer belt and the electrophotographic photosensitive member were integrally supported, image printing was also tested in the same manner as in Example 1, where color misregistration was seen from the beginning, and became more conspicuous with the progress of image printing. Thus, this intermediate transfer belt was found to be not suited for practical use.

The results of measurement and evaluation are shown in Table 1.

COMPARATIVE EXAMPLE 2

Six intermediate transfer belts were produced in the same manner as in Example 1 except that the mixing materials were changed as shown below and the finishing step making use of forms was not carried out.

| | |
|---|---|
| PVDF | 100 parts |
| Conductive carbon black | 18 parts |
| Metal oxide particles | 50 parts |

For the resultant intermediate transfer belts, physical properties were measured in the same manner as in Example 1. As a result, the modulus of elasticity at elongation from 0.5% to 0.6% of this intermediate transfer belt was found to be 1,500 MPa; the breaking extension, 2.5%; the surface roughness Ra, 1.1 μm; the thickness, 108 μm; and the volume resistivity, $1.2\times10^{8}$ Ω·cm.

Using this process cartridge in which the intermediate transfer belt and the electrophotographic photosensitive member were integrally supported, image printing was also tested in the same manner as in Example 1. As a result, coarse images were seen from the beginning, and faulty cleaning of the intermediate transfer belt was also seen to have occurred.

In addition, an extensive printing (running) test was also made, where the belt cracked at its edges upon printing about the 3,600th sheet and this belt was judged to be impermissible for practical use.

The results of measurement and evaluation are shown in Table 1.

TABLE 1

| | Modulus of elasticity (MPa) | Breaking extension (%) | Surface roughness Ra (μm) | Wall thickness (μm) | Volume resistivity (Ω·cm) | Print test results* Initial stage | After running | State of affairs |
|---|---|---|---|---|---|---|---|---|
| Example: | | | | | | | | |
| 1 | 815 | 20 | 0.03 | 102 | $7.8\times10^{10}$ | A | A | Good image quality. |
| 2 | 585 | 680 | 0.04 | 100 | $8.3\times10^{9}$ | A | A | Good image quality. |
| 3 | 2,300 | 56 | 0.08 | 100 | $2.2\times10^{12}$ | A | A | Good image quality. |
| 4 | 2,500 | 38 | 0.5 | 108 | $2.5\times10^{8}$ | B | B | Slightly coarse images. |
| Comparative Example: | | | | | | | | |
| 1 | 450 | 880 | 0.04 | 99 | $1.0\times10^{9}$ | C | C | Great color misregistration. |
| 2 | 1,500 | 2.5 | 1.1 | 108 | $1.2\times10^{8}$ | C | — | Coarse images; broken on 3,600th sheet printing. |

* A: Good; B: Permissible for practical use; C: Impermissible for practical use.

As having been described above, the present invention has made it possible to provide the process cartridge which is easy to maintain, can realize miniaturization and cost reduction of the apparatus, and affords good images even when they are transported or left over a long period of time; an intermediate transfer belt for such a process cartridge; and the electrophotographic apparatus having such a process cartridge.

What is claimed is:

1. A process cartridge which is detachably mountable to the main body of an electrophotographic apparatus, said process cartridge integrally comprising:

an electrophotographic photosensitive member configured and positioned to hold thereon a toner image;

an intermediate transfer belt having a contact zone coming into contact with said electrophotographic photosensitive member;

primary-transfer means for primarily transferring the toner image from said electrophotographic photosensitive member to said intermediate transfer belt at the contact zone; and charge-providing means for providing the toner on said intermediate transfer belt with electric charges having a polarity reverse to a polarity the toner has at the time of the primary transfer of the toner image from said electrophotographic photosensitive member to said intermediate transfer belt and returning the toner on said intermediate transfer belt to said electrophotographic photosensitive member at the contact zone to clean said intermediate transfer belt;

wherein said intermediate transfer belt has:

a modulus of elasticity of from 500 MPa to 4,000 MPa at elongation from 0.5% to 0.6% in the peripheral direction;

a breaking extension of from 5% to 850% in the peripheral direction; and a surface roughness Ra of 1 $\mu$m or less.

2. The process cartridge according to claim 1, further comprising an electrophotographic-photosensitive-member cleaning means for cleaning said electrophotographic photosensitive member.

3. The process cartridge according to claim 1, wherein said process cartridge is dividable into an electrophotographic photosensitive member unit having said electrophotographic photosensitive member and an intermediate transfer belt unit having said intermediate transfer belt, wherein said process cartridge further comprises joining means for joining said electrophotographic photosensitive member unit and said intermediate transfer belt unit together.

4. The process cartridge according to claim 1, wherein said intermediate transfer belt has a volume resistivity of $1\times10^{6}$ Ω·cm to $8\times10^{13}$ Ω·cm and a wall thickness of 40 $\mu$m to 300 $\mu$m.

5. The process cartridge according to claim 1, wherein said intermediate transfer belt is produced by an intermediate transfer belt production process comprising:

a melt-extrusion step of melt-extruding an extrusion material from a circular die to obtain a tubular film;

a diameter control step of blowing a gas into the tubular film having been melt-extruded through the melt-extrusion step, to regulate its internal volume to control the diameter of the tubular film;

a tubular-film forming step of forming a tubular film having a diameter larger than the diameter of the circular die without using any member with which the tubular film is supported, until the tubular film having been melt-extruded through the melt-extrusion step and diameter-controlled through the diameter control step cools to solidify; and a cutting step of cutting the tubular film having been formed through the tubular-film forming step.

6. The process cartridge according to claim 1, wherein said intermediate transfer belt is placed over and around rollers, and at least one of the rollers is slidable by at least 1 mm or more so that a force of 5 N or more can be applied to said intermediate transfer belt.

7. The process cartridge according to claim 1, wherein said intermediate transfer belt is placed over and around two rollers.

8. The process cartridge according to claim 1, wherein said electrophotographic photosensitive member is in the shape of a drum.

9. An electrophotographic apparatus comprising:

an electrophotographic photosensitive member configured and positioned to hold thereon a toner image;

charging means for charging said electrophotographic photosensitive member electrostatically;

exposure means for forming an electrostatic latent image on said electrophotographic photosensitive member thus charged by said charging means;

developing means for developing the electrostatic latent image formed on said electrophotographic photosensitive member by said exposure means, to form a toner image on said electrophotographic photosensitive member;

an intermediate transfer belt having a contact zone coming into contact with said electrophotographic photosensitive member, through which belt the toner image is primarily transferred from said electrophotographic photosensitive member and thereafter the toner image having primarily been transferred is secondarily transferred to a transfer medium;

primary-transfer means for primarily transferring the toner image from said electrophotographic photosensitive member to said intermediate transfer belt at the contact zone;

charge-providing means for providing the toner on said intermediate transfer belt with electric charges having a polarity reverse to a polarity the toner has at the time of the primary transfer and returning the toner on said intermediate transfer belt to said electrophotographic photosensitive member at the contact zone to clean said intermediate transfer belt; and electrophotographic-photosensitive-member cleaning means for cleaning said electrophotographic photosensitive member;

said electrophotographic apparatus having a process cartridge in which said electrophotographic photosensitive member, said intermediate transfer belt, said primary-transfer means, and said charge-providing means at least are integrally supported and detachably mountable on a main body of said electrophotographic apparatus, and said intermediate transfer belt having:

a modulus of elasticity of from 500 MPa to 4,000 MPa at elongation from 0.5% to 0.6% in the peripheral direction;

a breaking extension of from 5% to 850% in the peripheral direction; and a surface roughness Ra of 1 $\mu$m or less.

10. The electrophotographic apparatus according to claim 9, wherein said process cartridge further comprises said electrophotographic-photosensitive-member cleaning means for cleaning said electrophotographic photosensitive member.

11. The electrophotographic apparatus according to claim 9, wherein said process cartridge is dividable into an electrophotographic photosensitive member unit having said electrophotographic photosensitive member and an intermediate transfer belt unit having said intermediate transfer belt, and has joining means for joining said electrophotographic photosensitive member unit and said intermediate transfer belt unit together.

12. The electrophotographic apparatus according to claim 9, wherein said intermediate transfer belt has a volume resistivity of $1\times10^{6}$ Ω·cm to $8\times10^{13}$ Ω·cm and a wall thickness of 40 $\mu$m to 300 $\mu$m.

13. The electrophotographic apparatus according to claim 9, wherein said intermediate transfer belt is produced by an intermediate transfer belt production process comprising:

a melt-extrusion step of melt-extruding an extrusion material from a circular die to obtain a tubular film;

a diameter control step of blowing a gas into the tubular film having been melt-extruded through the melt-extrusion step, to regulate its internal volume to control the diameter of the tubular film;

a tubular-film forming step of forming a tubular film having a diameter larger than the diameter of the circular die without using any member with which the tubular film is supported, until the tubular film having been melt-extruded through the melt-extrusion step and diameter-controlled through the diameter control step cools to solidify; and a cutting step of cutting the tubular film having been formed through the tubular-film forming step.

14. The electrophotographic apparatus according to claim 9, wherein said intermediate transfer belt is placed over and around rollers, and at least one of the rollers is slidable by at least 1 mm or more so that a force of 5 N or more can be applied to said intermediate transfer belt.

15. The electrophotographic apparatus according to claim 9, wherein said intermediate transfer belt is placed over and around two rollers.

16. The electrophotographic apparatus according to claim 9, wherein said electrophotographic photosensitive member is in the shape of a drum.

17. An image-forming method comprising:

a charging step of electrostatically charging an electrophotographic photosensitive member;

an exposure step of forming an electrostatic latent image on the electrophotographic photosensitive member thus charged in said charging step;

a developing step of developing the electrostatic latent image formed on the electrophotographic photosensitive member in said exposure step, to form a toner image on the electrophotographic photosensitive member;

a primary-transfer step of primarily transferring the toner image formed in said developing step from the electrophotographic photosensitive member to an intermediate transfer belt by a primary-transfer means, the intermediate transfer belt having a contact zone coming into contact with the electrophotographic photosensitive member;

a secondary-transfer step for secondarily transferring to a transfer medium the toner image having primarily been transferred in said primary-transfer step;

a charge-providing step of providing the toner on the intermediate transfer belt with electric charges by charge-providing means, the electric charges having a polarity reverse to the polarity the toner has at the time of the primary transfer;

an intermediate-transfer-belt cleaning step of returning the toner on the intermediate transfer belt to the electrophotographic photosensitive member at the contact zone to clean the intermediate transfer belt; and an electrophotographic-photosensitive-member cleaning step of cleaning the electrophotographic photosensitive member, said image-forming method making use of an electrophotographic apparatus having a process cartridge in which the electrophotographic photosensitive member, the intermediate transfer belt, the primary-transfer means and the charge-providing means at least are integrally supported and detachably mountable to a main body of the electrophotographic apparatus, and the intermediate transfer belt having:

a modulus of elasticity of from 500 MPa to 4,000 MPa at elongation from 0.5% to 0.6% in the peripheral direction;

a breaking extension of from 5% to 850% in the peripheral direction; and a surface roughness Ra of 1 $\mu$m or less.

18. The image-forming method according to claim 17, wherein the process cartridge further comprises an electrophotographic- photosensitive-member cleaning means for cleaning the electrophotographic photosensitive member.

19. The image-forming method according to claim 17, wherein the process cartridge is dividable into an electrophotographic photosensitive member unit having the electrophotographic photosensitive member and an intermediate transfer belt unit having the intermediate transfer belt, and has joining means for joining the electrophotographic photosensitive member unit and the intermediate transfer belt unit together.

20. The image-forming method according to claim 17, wherein the intermediate transfer belt has a volume resistivity of $1\times10^{6}$ Ω·cm to $8\times10^{13}$ Ω·cm and a wall thickness of 40 $\mu$m to 300 $\mu$m.

21. The image-forming method according to claim 17, wherein the intermediate transfer belt is produced by an intermediate transfer belt production process comprising:

a melt-extrusion step of melt-extruding an extrusion material from a circular die to obtain a tubular film;

a diameter control step of blowing a gas into the tubular film having been melt-extruded through the melt-extrusion step, to regulate its internal volume to control the diameter of the tubular film;

a tubular-film forming step of forming a tubular film having a diameter larger than the diameter of the circular die without using any member with which the tubular film is supported, until the tubular film having been melt-extruded through the melt-extrusion step and diameter-controlled through the diameter control step cools to solidify; and a cutting step of cutting the tubular film having been formed through the tubular-film forming step.

22. The image-forming method according to claim 17, wherein the intermediate transfer belt is placed over and around rollers, and at least one of the rollers is slidable by at least 1 mm or more so that a force of 5 N or more can be applied to the intermediate transfer belt.

23. The image-forming method according to claim 17, wherein the intermediate transfer belt is placed over and around two rollers.

24. The image-forming method according to claim 17, wherein the electrophotographic photosensitive member is in the shape of a drum.

* * * * *

UNITED STATES PATENT AND TRADEMARK OFFICE

CERTIFICATE OF CORRECTION

PATENT NO. : 6,615,015 B2
DATED : September 2, 2003
INVENTOR(S) : Akihiko Nakazawa et al.

It is certified that error appears in the above-identified patent and that said Letters Patent is hereby corrected as shown below:

Column 1,
Line 28, “have” should read -- has --.

Column 2,
Line 61, “difficulties” should read -- difficulties with --.

Column 8,
Line 9, “06^” should read -- 0.6% --.
Line 54, “melt” should read -- melt- --.

Column 9,
Line 33, “appratus” should read -- apparatus --.
Line 47, “uniformly” should read -- uniformly with --.

Column 10,
Line 53, “etrusion” should read -- extrusion --.

Column 14,
Line 34, “box.,” should read -- box. --.

Signed and Sealed this

Thirteenth Day of April, 2004

JON W. DUDAS
*Acting Director of the United States Patent and Trademark Office*